US009965916B2

(12) United States Patent
Komatsu et al.

(10) Patent No.: US 9,965,916 B2
(45) Date of Patent: May 8, 2018

(54) MEDIUM BUNDLE STORAGE DEVICE AND MEDIUM PROCESSING DEVICE

(71) Applicant: Oki Electric Industry Co., Ltd., Tokyo (JP)

(72) Inventors: Hirokazu Komatsu, Tokyo (JP); Ryuuji Kobayashi, Tokyo (JP)

(73) Assignee: Oki Electric Industry Co., Ltd., Tokyo (JP)

( * ) Notice: Subject to any disclaimer, the term of this patent is extended or adjusted under 35 U.S.C. 154(b) by 0 days. days.

(21) Appl. No.: 15/545,306

(22) PCT Filed: Jan. 15, 2016

(86) PCT No.: PCT/JP2016/051143
§ 371 (c)(1),
(2) Date: Jul. 20, 2017

(87) PCT Pub. No.: WO2016/136320
PCT Pub. Date: Sep. 1, 2016

(65) Prior Publication Data

US 2018/0018848 A1 Jan. 18, 2018

(30) Foreign Application Priority Data

Feb. 24, 2015 (JP) ..... 2015-034243

(51) Int. Cl.
*G07D 11/00* (2006.01)
*G07F 19/00* (2006.01)

(52) U.S. Cl.
CPC ..... *G07D 11/0027* (2013.01); *G07F 19/20* (2013.01); *B65H 2301/42242* (2013.01);
(Continued)

(58) Field of Classification Search
CPC ..... G07D 11/0027; G07D 9/00; G07D 19/20; B65H 2301/42242; B65H 2403/50;
(Continued)

(56) References Cited

U.S. PATENT DOCUMENTS 4,635,661 A * 1/1987 Uematsu ..... G07F 5/24 194/217
2013/0247799 A1* 9/2013 Furuichi ..... G07D 11/0084 109/23
2014/0216888 A1* 8/2014 Horigome ..... G07F 19/20 194/206

FOREIGN PATENT DOCUMENTS

JP S62-089065 U 6/1987
JP H06-309542 A 11/1994
(Continued)

*Primary Examiner* — David H Bollinger
(74) *Attorney, Agent, or Firm* — Rabin & Berdo, P.C.

(57) ABSTRACT

A reject storage box is provided with a sufficiently thick cover body above a second storage space that stores banknote bundles W that a user has forgotten to take, and a guide space is provided penetrating the cover body in an oblique direction. In the reject storage box, when a banknote bundle falls into an intake hole from above, a lower face of the banknote bundle immediately contacts a position toward the top of a main guide face, and the banknote bundle W travels downward through the guide space with the lower face of the banknote bundle W sliding against the main guide face. The reject storage box thereby enables the banknote bundle dropping downward through the guide space to be maintained in a substantially uniform orientation, and ultimately enables the banknote bundle to be stacked neatly inside the second storage space.

9 Claims, 9 Drawing Sheets

(52) U.S. Cl.
CPC ..... *B65H 2403/50* (2013.01); *B65H 2405/50* (2013.01); *B65H 2408/10* (2013.01); *B65H 2601/27* (2013.01); *B65H 2701/1912* (2013.01)

(58) Field of Classification Search
CPC ..... B65H 2405/50; B65H 2408/10; B65H 2601/27; B65H 2701/1912
See application file for complete search history.

(56) References Cited

FOREIGN PATENT DOCUMENTS

| | | | |
|---|---|---|---|
| JP | H10-021447 | A | 1/1998 |
| JP | 5156097 | B2 | 3/2013 |

* cited by examiner

MEDIUM BUNDLE STORAGE DEVICE AND MEDIUM PROCESSING DEVICE

TECHNICAL FIELD

The present invention relates to a medium bundle storage device and a medium processing device, applied to, for example, a banknote pay-out device that pays out banknotes serving as a medium.

BACKGROUND ART

Banknote pay-out devices that pay out cash such as banknotes or coins in response to a request by a user (for example a customer of a financial institution) are widely employed in financial institutions and the like.

A proposal for such a banknote pay-out device includes, for example, banknote storage boxes that store banknotes, a conveyance section that conveys banknotes, a classification section that classifies banknotes, a stacking section that stacks banknotes that can be paid out into a banknote bundle, a reject storage box that stores reject banknotes that are unsuitable for pay-out, a bundle conveyance section that conveys the banknote bundle, and a pay-out port that passes the banknote bundle to a user (see, for example, Japanese Patent No. 5156097 (FIG. 1)).

SUMMARY OF INVENTION

Technical Problem

Sometimes, the reject storage box is, for example, disposed below the bundle conveyance section, and is formed with an intake hole in communication with the bundle conveyance section at an upper face. If a user forgets to take a banknote bundle from the pay-out port, the banknote pay-out device is capable of taking in the banknote bundle using the bundle conveyance section, conveying the banknote bundle with the bundle conveyance section, and causing the banknote bundle to fall into the reject storage box through the intake hole, to be stored in the reject storage box.

However, sometimes the orientation of a banknote bundle falling through the intake hole in the reject storage box changes, or the stacking collapses, as it falls from the bundle conveyance section. In such cases, banknotes are stored untidily in the reject storage box of the banknote pay-out device, leading to issues such as necessitating work to arrange the banknotes upon retrieval, or leaving banknotes partially sticking out from the intake hole of the reject storage box into the bundle conveyance section, potentially causing faults during subsequent banknote pay-out operations or the like.

In consideration of the above circumstances, the present invention proposes a medium bundle storage device and a medium processing device capable of neatly storing a medium bundle that has been taken in.

Solution to Problem

A medium bundle storage device of the present invention addressing the above issues includes an intake hole that takes in a medium bundle of a stacked paper sheet shaped medium, a medium bundle storage space that is disposed further toward a lower side than the intake hole, and that stores the medium bundle, a main guide face that connects the intake hole and the medium bundle storage space together, and that is inclined with respect to a horizontal direction, an auxiliary guide face that faces the main guide face across a separation of at least a specific guide spacing, and a guide space that is formed between the main guide face and the auxiliary guide face, and that guides the medium bundle toward the medium bundle storage space.

A medium processing device of the present invention includes a bundle conveyance section that conveys a medium bundle of a stacked paper sheet shaped medium, and a medium bundle storage box that takes in and stores the medium bundle conveyed by the bundle conveyance section. The medium bundle storage box includes an intake hole that takes in the medium bundle from the bundle conveyance section, a medium bundle storage space that is disposed further toward a lower side than the intake hole, and that stores the medium bundle, a main guide face that connects the intake hole and the medium bundle storage space together, and that is inclined with respect to a horizontal direction, an auxiliary guide face that faces the main guide face across a separation of at least a specific guide spacing, and a guide space that is formed between the main guide face and the auxiliary guide face, and that guides the medium bundle toward the medium bundle storage space.

This thereby enables a medium bundle that has been taken in through the intake hole to be made to travel by sliding against the main guide face in the guide space, such that the medium bundle can reach the medium bundle storage space without losing its orientation in the guide space, and can be stored neatly.

Advantageous Effects of Invention

The present invention enables a medium bundle storage device and a medium processing device capable of neatly storing a medium bundle that has been taken in.

DESCRIPTION OF EMBODIMENTS

Explanation follows regarding an embodiment of the present invention (referred to below as an exemplary embodiment), with reference to the drawings.

1. Banknote Pay-Out Device Configuration

Figure 1:
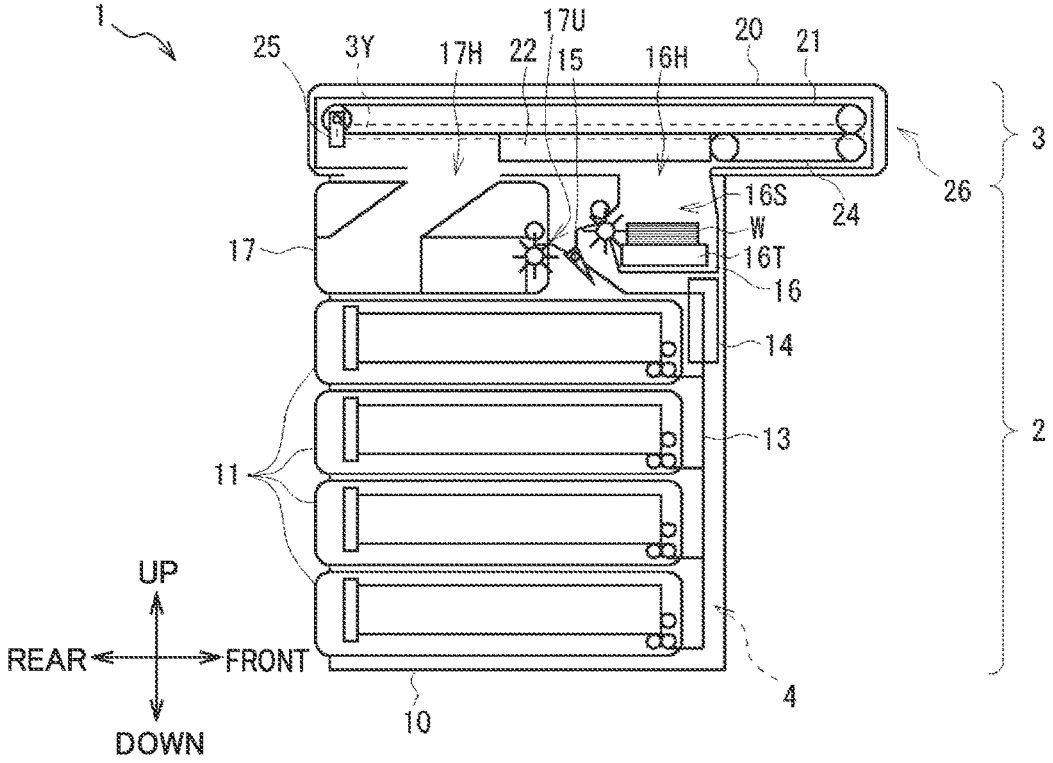
FIG. 1 is a schematic line drawing illustrating configuration of a banknote pay-out device.

As illustrated in schematic side view in FIG. 1, a banknote pay-out device 1 is what is referred to as a cash dispenser, for installation in financial institutions, various commercial premises, or the like. The banknote pay-out device 1 pays out banknotes based on operation by a user (for example, namely a customer of the financial institution or the commercial premises). The banknote pay-out device 1 has a configuration broadly divided into a storage unit 2 on a lower side, and a bundle conveyance unit 3 on an upper side, and is incorporated with a controller 4 that controls the overall banknote pay-out device 1.

The controller 4 is configured around a Central Processing Unit (CPU), not illustrated in the drawings, and performs processing such as pay-out processing by reading and executing a specific program from Read Only Memory (ROM), flash memory, or the like, not illustrated in the drawings. The controller 4 also includes an internal memory section configured by Random Access Memory (RAM), a hard disk drive, flash memory, or the like, and stores various information in the memory section In the following explanation, the front side is defined as the side of the banknote pay-out device 1 that the customer faces, and the back side is defined as the opposite side thereto. The left side and the right side are defined as the left and the right as seen by the customer facing the front side, and the upper side and the lower side are also defined.

1-1. Storage Unit Configuration

In the storage unit 2, plural sections that perform various processing relating to banknotes are incorporated inside a rectangular block shaped storage casing 10. Four banknote storage boxes 11, a conveyance section 13, a classification section 14, a switching section 15, a stacking section 16, and a reject storage box 17 are provided inside the storage casing 10.

The banknote storage boxes 11 are attached one on top of the other from the up-down direction center toward the lower side at the rear side of the storage casing 10, and are respectively stored with banknotes of a predetermined denomination. A feed-out section is provided at a front side lower portion of each banknote storage box 11, to separate and feed out stored banknotes one note at a time.

The conveyance section 13 configures a conveyance path, this being a path along which banknotes are conveyed, from rollers, belts, and a motor or the like that drives them, not illustrated in the drawings. As shown by solid lines in the drawings, the conveyance path is connected to the feed-out section of each banknote storage box 11, and is disposed so as to advance along the up-down direction at the front side of the respective banknote storage boxes 11 before reaching the vicinity of the front-rear direction center at the upper side of the banknote storage box 11 at the uppermost position.

The classification section 14 is provided along the conveyance path of the conveyance section 13, at the front side of the banknote storage box 11 positioned at the uppermost side. Plural sensors of various types, such as a thickness sensor and an image sensor, are incorporated inside the classification section 14. The classification section 14 classifies the denomination and travel state of conveyed banknotes based on information obtained from the respective sensors, and supplies the classification results to the controller 4. The controller 4 determines the conveyance destination of each banknote based on the acquired classification results. Specifically, the controller 4 determines the stacking section 16 to be the conveyance destination for normal banknotes that are suitable for pay-out, and determines the reject storage box 17 to be the conveyance destination for banknotes that are unsuitable for pay-out due to conveyance deficiencies or the like (referred to below as reject banknotes).

The switching section 15 is disposed substantially at the front-rear direction center at the upper side of the banknote storage box 11 positioned at the uppermost side. Under the control of the controller 4, the switching section 15 switches the banknote conveyance path by changing an angle of inclination of a blade (illustrated in a triangular shape in the drawings) that contacts banknotes so as to change their direction of travel. The switching section 15 is connected through the conveyance section 13 to the classification section 14 at the lower side, the stacking section 16 at the front side, and the reject storage box 17 at the rear side. The switching section 15 switches the direction of travel of the respective banknotes conveyed from below according to the conveyance destination determined by the controller 4, and moves the banknotes to the stacking section 16 at the front side or the reject storage box 17 at the rear side.

The stacking section 16 is positioned at the front side of an uppermost side inside the storage casing 10. A stacking space 16S in which banknotes are stacked is formed inside the stacking section 16. The stacking section 16 includes a stage 16T, on an upper face of which banknotes are stacked, inside the stacking space 16S.

A discharge section for discharging banknotes conveyed from the switching section 15 into the stacking space 16S is provided toward the top of the rear side of the stacking section 16. The stacking section 16 thereby stacks banknotes conveyed from the switching section 15 and discharged into the stacking space 16S by the discharge section into a bundle on the stage 16T. Banknotes stacked in this manner are therefore also referred to below as a banknote bundle W. Note that the banknote bundle W is not wrapped with a paper band or the like, but is simply a pile of stacked banknotes, and so there is a possibility of the banknote bundle W collapsing if unintentionally applied with external force.

The stage 16T can also be moved in an up-down direction by a stage moving mechanism, not illustrated in the drawings. An upper face of the stacking section 16 is provided with a stacking hole 16H penetrating in the up-down direction over a range corresponding to the stacking space 16S. The stacking hole 16H also penetrates an upper face of the storage casing 10, and places the stacking space 16S in communication with a space further toward the upper side than the storage casing 10. The stacking section 16 is thereby capable of lifting the stage 16T and the stacked bundle of banknotes (banknote bundle W) further toward the upper side than the upper face of the storage casing 10, namely to inside the bundle conveyance unit 3, by moving the stage 16T upward in a state in which banknotes have been stacked on the stage 16T.

The reject storage box 17 is positioned at the rear side of an uppermost side inside the storage casing 10, and includes an internal space that stores banknotes and banknote bundles W. A passage hole 17U through which banknotes are passed one note at a time is provided slightly below midway on a front face of the reject storage box 17, and an intake hole 17H is formed at an upper face of the reject storage box 17.

The reject storage box 17 is accordingly capable of internally storing banknotes (namely reject banknotes) conveyed from the switching section 15 that have passed through the passage hole 17U. The reject storage box 17 is also capable of taking in and internally storing a banknote bundle W through the intake hole 17H when a banknote bundle W falls from the bundle conveyance unit 3 positioned above the reject storage box 17.

The banknote storage boxes 11 and the reject storage box 17 can be detached from the storage casing 10 by being pulled out in the rear direction with respect to the storage casing 10. The banknote storage boxes 11 and the reject storage box 17 can also be mounted in the storage casing 10 by being positioned with respect to the storage casing 10 and being pushed toward the front direction.

1-2. Bundle Conveyance Unit Configuration

The bundle conveyance unit 3, serving as a bundle conveyance section, is formed overall in a flattened rectangular block shape that is short in the up-down direction and long in the front-rear direction. The front-rear direction length of the bundle conveyance unit 3 is longer than that of the storage unit 2. The bundle conveyance unit 3 forms a bundle conveyance path 3Y, this being a path along which a banknote bundle W passes when conveying the banknote bundle W, from various members incorporated inside a rectangular block shaped bundle conveyance casing 20. A front end of the bundle conveyance casing 20, namely a front end of the bundle conveyance path 3Y, is formed with a pay-out port 26 that hands over the banknote bundle W to the user.

Note that respective sensors for detecting a banknote bundle W are provided at plural locations along the bundle conveyance path 3Y, for example in the vicinity of the pay-out port 26. The sensors are configured by combinations of light emitting elements that emit a specific detection light, and light receiving elements that receive the specific detection light. Optical paths of the detection light intersect the bundle conveyance path 3Y, and the controller 4 is notified of light reception results for the detection light. The controller 4 is capable of determining whether or not a banknote bundle W is present at each location along the bundle conveyance path 3Y based on the light reception results.

An upper conveyor belt 21 is provided at an upper side portion inside the bundle conveyance casing 20. The upper conveyor belt 21 is entrained around the peripheries of respective rollers disposed in the vicinity of a rear end and in the vicinity of a front end of the upper conveyor belt 21, and when the rollers are rotated by a specific motor (not illustrated in the drawings) under control of the controller 4, a lower face of the upper conveyor belt 21 travels along the front-rear direction. For ease of explanation, in the following explanation the direction of travel of the lower face portion of the upper conveyor belt 21 is taken as the direction of travel of the upper conveyor belt 21.

A gripping conveyance guide 22 and a lower conveyor belt 24 are provided inside the bundle conveyance casing 20 at a portion to the lower side of the upper conveyor belt 21, namely on the opposite side of the bundle conveyance path 3Y to the upper conveyor belt 21.

The gripping conveyance guide 22 is formed in a flattened rectangular block shape or a plate shape that is thin in the up-down direction, and an upper face of the gripping conveyance guide 22 opposes or abuts the lower face of the upper conveyor belt 21. Note that the length of the gripping conveyance guide 22 in the left-right direction is longer than the length of a long edge of a banknote. The gripping conveyance guide 22 faces the upper face of the storage casing 10 of the storage unit 2, and is attached thereto through a movement mechanism, not illustrated in the drawings, so as to be capable of moving in the front-rear direction. When the gripping conveyance guide 22 has been moved to the rear, the stacking hole 16H is opened up, placing the space inside the stacking section 16 in communication with the bundle conveyance path 3Y. When the gripping conveyance guide 22 has been moved to the front, the intake hole 17H is opened up, placing the space inside the reject storage box 17 in communication with the bundle conveyance path 3Y.

The lower conveyor belt 24 has a configuration similar to that of the upper conveyor belt 21, but shortened in the front-rear direction. An upper face portion of the lower conveyor belt 24 is aligned so as to be level with the upper face of the gripping conveyance guide 22, and faces or abuts the lower face of the upper conveyor belt 21. Namely, the upper face of the lower conveyor belt 24 forms a lower face portion of the bundle conveyance path 3Y together with the upper face of the gripping conveyance guide 22. The upper face of the lower conveyor belt 24 travels in the front-rear direction, similarly to the lower face of the upper conveyor belt 21. For ease of explanation, in the following explanation the direction of travel of the upper face portion of the lower conveyor belt 24 is taken as the direction of travel of the lower conveyor belt 24.

The stage 16T of the stacking section 16 is moved upward in a state in which the gripping conveyance guide 22 has been moved to the front (FIG. 1), to align the height of the upper face of the stage 16T so as to be substantially level with the gripping conveyance guide 22. The stage 16T accordingly forms part of the bundle conveyance path 3Y.

A Russell plow section 25 pushes a banknote bundle W to move it in the front-rear direction along the gripping conveyance guide 22, the lower conveyor belt 24, and the upper face of the stage 16T. The banknote bundle W can accordingly be moved along the bundle conveyance path 3Y in the front-rear direction in an orientation in which the short edges of the respective banknotes are aligned with the front-rear direction.

1-3. Reject Storage Box Configuration

Figure 2A:
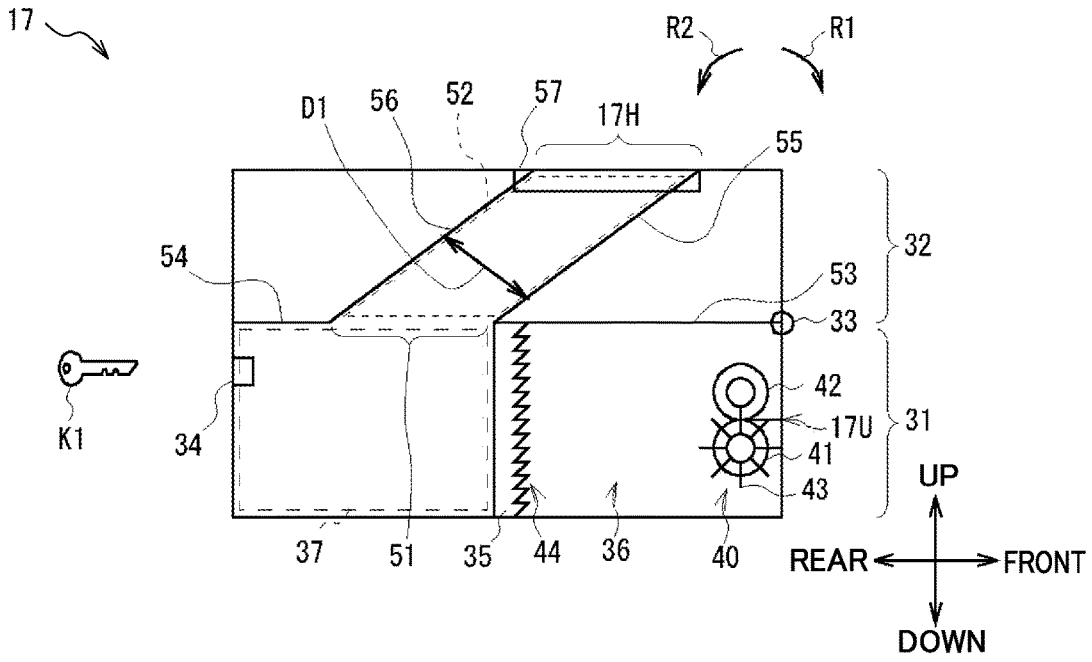
FIG. 2A is a schematic line drawing illustrating configuration of a reject storage box.

Next, explanation follows regarding configuration of the reject storage box 17. As illustrated in FIG. 2A, the reject storage box 17 is configured by a storage body 31 that takes up a lower side portion, and a cover body 32 that takes up an upper side portion, connected together through a pivot portion 33.

The storage body 31 and the cover body 32 are both formed in rectangular block shapes, and have matching lengths in the front-rear direction and the left-right direction. The pivot portion 33 is a pivoting mechanism with its axial center running in the left-right direction, and is attached to the vicinity of an upper end of a front face of the storage body 31, and the vicinity of the lower end of a front face of the cover body 32, respectively. The pivot portion 33 enables the cover body 32 to turn with respect to the storage body 31 in an arrow R1 direction, this being the clockwise direction in the drawings, or in an arrow R2 direction, this being the opposite direction thereto.

Figure 3:
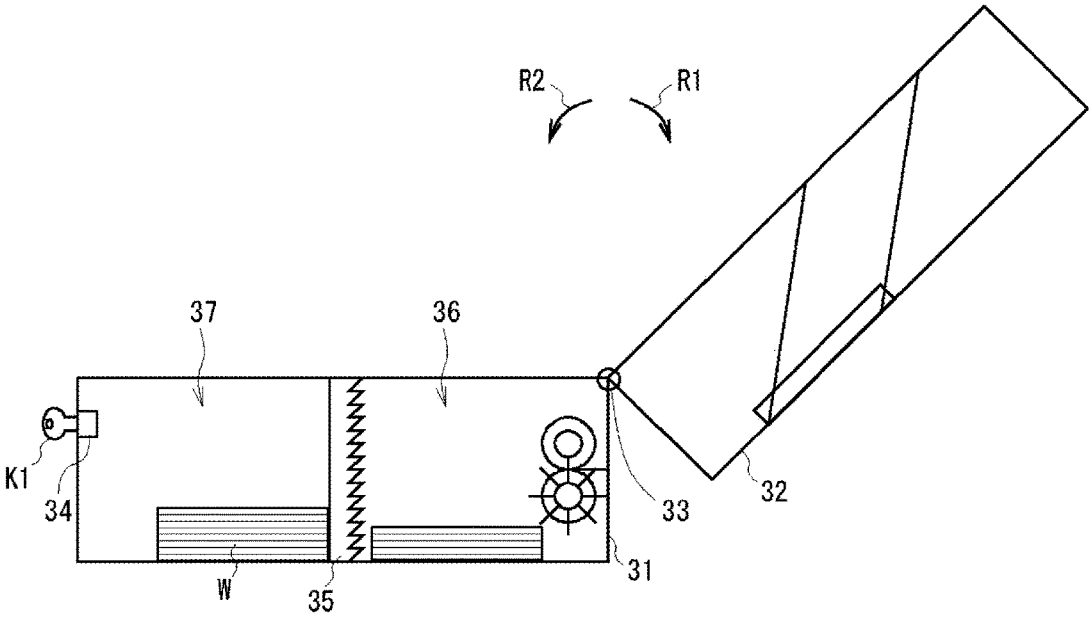
FIG. 3 is a schematic line drawing illustrating opening of a cover body of a reject storage box.

Namely, the reject storage box 17 is capable of transitioning from a state in which the cover body 32 is superimposed directly above the storage body 31 as illustrated in FIG. 2A (referred to below as a closed state) to a state in which the cover body 32 is positioned in front of and above the storage body 31 as illustrated in FIG. 3 (referred to below as an open state), by turning the storage body 31 toward the arrow R1 direction. The reject storage box 17 is capable of returning from the open state (FIG. 3) to the closed state (FIG. 2A) in which the cover body 32 is superimposed directly above the storage body 31 by turning the cover body 32 toward the arrow R2 direction.

A lock 34 that is locked or unlocked using a key K1 is provided at a rear face of the storage body 31. When the lock 34 is locked with the cover body 32 is in the closed state, the closed state is maintained, preventing transition to the open state. Unlocking the lock 34 with the key K1 permits transition of the cover body 32 to the open state.

The storage body 31 is formed in a hollow rectangular block shape, and is open at an upper face. A plate shaped partitioning plate 35 positioned substantially at the front-rear direction center of the storage body 31 splits the inside of the storage body 31 into a first storage space 36, serving as a separate storage space, positioned at a front side, and a second storage space 37 (the portion enclosed by large-dashed intermittent lines in the drawings), serving as a medium bundle storage area, positioned at a rear side.

The front face of the storage body 31, namely a front face of the first storage space 36, is formed with the passage hole 17U that allows banknotes conveyed from the switching section 15 to pass through, as described above. A discharge section 40 is provided inside the first storage space 36 at the rear of the passage hole 17U. The discharge section 40 is configured by drive rollers 41 and following rollers 42.

Each drive roller 41 is formed in a short circular column shape with a central shaft running in the left-right direction. Drive force is transmitted to the drive rollers 41 from a drive source, not illustrated in the drawings, thereby rotating the drive rollers 41 in the arrow R2 direction. Note that plural of the drive rollers 41 are disposed in a row along the left-right direction in the discharge section 40. The height of the drive rollers 41 is adjusted such that upper edges of the drive rollers 41 are substantially level with the passage hole 17U.

Each following roller 42 is formed in a short circular column shape with a central shaft running in the left-right direction, similarly to the drive rollers 41, and is capable of rotating. Note that in the discharge section 40, the following rollers 42 are disposed in a row along the left-right direction in the same number as the number of the drive rollers 41, and at positions corresponding to the respective drive rollers 41. The following rollers 42 are pressed against the drive rollers 41 by springs, not illustrated in the drawings, and rotate in the arrow R1 direction due to drive force transmitted from the drive rollers 41.

A tongue piece roller 43 is provided inside the first storage space 36. The tongue piece roller 43 is configured by a central portion that has a circular column shape with a smaller radius than that of the drive rollers 41, and plural tongue pieces configured by long, thin resilient bodies formed along radiating directions are attached to the central portion. The central portion of the tongue piece roller 43 is attached to the central shaft of the drive rollers 41, and rotates in the arrow R2 direction similarly to the drive rollers 41.

Anti-sliding grooves 44 are formed to a front inside face of the first storage space 36, namely to a rear face of the partitioning plate 35. The anti-sliding grooves 44 are formed running along the left-right direction, and plural of the anti-sliding grooves 44 are arranged side-by-side along the up-down direction. A side face on the lower side of each anti-sliding groove 44 runs substantially horizontally, and a side face on the upper side of each anti-sliding groove 44 heads obliquely downward toward the rear.

When a banknote is inserted through the passage hole 17U into the discharge section 40 configured in this manner in a state in which the drive rollers 41 and the following rollers 42 are respectively rotating in the arrow R2 direction and the arrow R1 direction, the banknote is gripped and moved toward the rear, and discharged into the first storage space 36. The discharged banknote strikes the front face of the partitioning plate 35, namely the anti-sliding grooves 44, and is maintained in a substantially horizontal orientation without allowing a front edge of the banknote to slide downward. The rotating tongue pieces of the tongue piece roller 43 tap the vicinity of the front edge of the banknote downward, namely in a direction away from the discharge section 40, this being a stacking direction of the banknotes. The banknote is thereby stacked inside the first storage space 36.

The cover body 32 is formed in a rectangular block shape, and is completely closed around its periphery. However, a guide space 52 (the portion enclosed by fine-dashed intermittent lines in the drawings) is formed running in an oblique direction so as to join the intake hole 17H, formed further toward the rear side than the center of an upper face of the cover body 32, to an entry hole 51 formed further toward the front side than the center of a lower face of the cover body 32. When the cover body 32 is in the closed state (FIG. 2A), the guide space 52 is in communication with the second storage space 37 through the entry hole 51. Portions of the lower face of the cover body 32 further toward the rear side and further toward the front side than the entry hole 51 are respectively closed off by the a rear lower side plate 53 and a front lower side plate 54.

A main guide face 55 is formed at the front side of the guide space 52. The main guide face 55 is a flat inclined face connecting between a front upper side to a rear lower side, and faces toward the upper rear side. A lower end of the main guide face 55 is positioned almost directly above the partitioning plate 35 when the reject storage box 17 is in the closed state.

An auxiliary guide face 56 is formed at the rear side of the guide space 52. The auxiliary guide face 56 is a flat inclined face connecting between a front upper side to a rear lower side, and faces toward the lower front side. The auxiliary guide face 56 faces the main guide face 55, with which it is substantially parallel. A guide spacing D1, this being the spacing between the main guide face 55 and the auxiliary guide face 56, is set longer than the thickness of a banknote bundle W when the maximum number of stacked banknotes are present (for example 100 banknotes), and is shorter than the length of the banknote short edge, namely the length along the direction of travel when a banknote bundle W is being conveyed along the bundle conveyance path 3Y (FIG. 1).

Figure 2B:
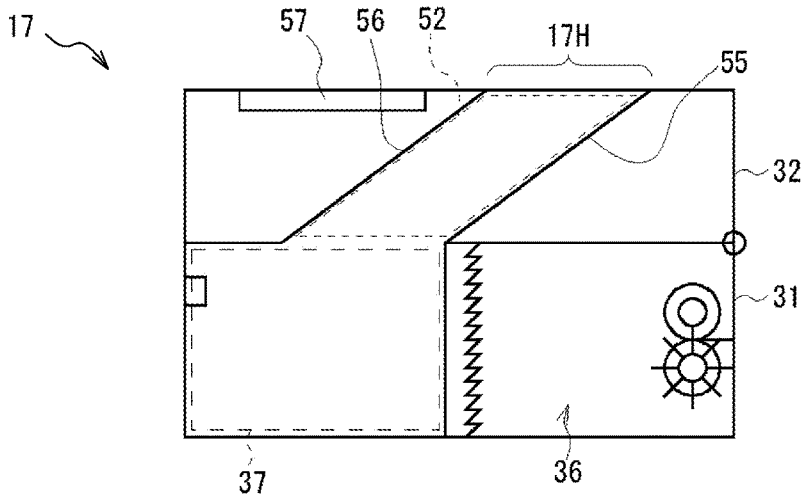
FIG. 2B is a schematic line drawing illustrating configuration of a reject storage box.

A shutter 57 is provided in the vicinity of the upper face of the cover body 32. The shutter 57 is formed with a plate shape that is thin in the up-down direction, and is greater in length than the intake hole 17H in both the front-rear direction and the left-right direction. The shutter 57 is configured so as to be capable of moving along the front-rear direction. Namely, when moved to the rear, the shutter 57 closes the intake hole 17H as illustrated in FIG. 2A, and when moved to the front, the shutter 57 opens up the intake hole 17H as illustrated in FIG. 2B.

The shutter 57 opens and closes in coordination with attachment and detachment of the reject storage box 17 with respect to the storage casing 10 of the storage unit 2. Namely, the shutter 57 moves to the rear to open the intake hole 17H when the reject storage box 17 has been mounted to the storage casing 10. The shutter 57 moves to the front the close the intake hole 17H when the reject storage box 17 has been removed from the storage casing 10.

2. Pay-Out Operation and Take-In Operation

The banknote pay-out device 1 begins a pay-out operation on receipt of a pay-out instruction and a pay-out amount from a user operating an operation section, not illustrated in the drawings. Specifically, the controller 4 of the banknote pay-out device 1 feeds out banknotes from the banknote storage boxes 11 one after another in denominations and quantities to make up the pay-out amount, and conveys the banknotes upward using the conveyance section 13, with the short edges of the banknotes aligned with the direction of travel. The banknotes are then classified by the classification section 14. When this is performed, the controller 4 determines the conveyance destination of each banknote to be either the stacking section 16 or the reject storage box 17 according to whether or not the banknote can be paid out, based on classification results obtained from the classification section 14.

The controller 4 then conveys the banknotes classified by the classification section 14 upward and toward the rear, so as to reach the switching section 15, using the conveyance section 13. The switching section 15 switches the direction of travel according to the conveyance destination determined for each banknote under the control of the controller 4, and the banknotes are conveyed to either the stacking section 16 or the reject storage box 17. Using the discharge section 40, the reject storage box 17 (FIG. 2A, FIG. 2B) discharges banknotes (namely reject banknotes) conveyed from the switching section 15 (FIG. 1) into the first storage space 36 to be stacked.

Using the discharge section, the stacking section 16 discharges conveyed banknotes into the stacking space 16S to be stacked on the stage 16T. The controller 4 continuously tallies the denominations and numbers of banknotes with a conveyance destination of the stacking section 16, namely banknotes stacked in the stacking section 16, and stops feeding banknotes out from the banknote storage boxes 11 at a stage when the tallied amount has reached the pay-out amount. A banknote bundle W, in which banknotes corresponding to the pay-out amount are stacked in a bundle, is thereby placed on the stage 16T of the stacking section 16.

Next, the controller 4 opens the stacking hole 16H of the stacking section 16 and closes the intake hole 17H by moving the gripping conveyance guide 22 to the rear, and then lifts the banknote bundle W into the bundle conveyance path 3Y by moving the stage 16T upward. The controller 4 also moves the banknote bundle W along the bundle conveyance path 3Y toward the front by making the upper conveyor belt 21 travel toward the front and moving the Russell plow section 25 toward the front. When this is performed, when the banknote bundle W reaches a position abutting the upper face of the lower conveyor belt 24, the controller 4 uses the upper conveyor belt 21 and the lower conveyor belt 24 to grip the banknote bundle W from above and below, and conveys the banknote bundle W toward the front using the travel of both belts.

Finally, when the controller 4 detects that the banknote bundle W has reached the pay-out port 26 due to notification from a sensor, not illustrated in the drawings, the controller 4 stops the travel of the upper conveyor belt 21 and the lower conveyor belt 24. The controller 4 also moves the Russell plow section 25 such that it reaches the vicinity of the front end of the bundle conveyance path 3Y. The Russell plow section 25 is thereby cleared to above the bundle conveyance path 3Y with a clearance mechanism (not illustrated in the drawings).

The controller 4 thereby ends the pay-out operation in a state in which part of the banknote bundle W is exposed from the pay-out port 26, and the vicinity of a rear edge of the banknote bundle W is gripped by the upper conveyor belt 21 and the lower conveyor belt 24. The banknote pay-out device 1 can accordingly allow the user to take out the banknote bundle W.

Note that the controller 4 monitors whether or not the banknote bundle W has been taken out of the pay-out port 26 based on notification from a sensor (not illustrated in the drawings). In cases in which the banknote bundle W has still not been taken when a specific waiting time (for example 30 seconds) has elapsed, the controller 4 considers the banknote bundle W to have been forgotten, and begins a take in operation to take in the banknote bundle W. Such banknotes that are forgotten by a user are referred to below as forgotten banknotes or retracted banknotes.

Specifically, the controller 4 takes the banknote bundle W into the bundle conveyance path 3Y and moves it along the bundle conveyance path 3Y toward the rear by making the upper conveyor belt 21 and the lower conveyor belt 24 travel toward the rear with the Russell plow section 25 still in a cleared state overhead. When this is performed, the controller 4 assists conveyance of the banknote bundle W toward the rear by moving the Russell plow section 25 toward the rear and returning the Russell plow section 25 to within the bundle conveyance path 3Y at the front side of the banknote bundle W, and then moving the Scott-Russell section 25 further toward the rear when, using a sensor, not illustrated in the drawings, the controller 4 has detected that the banknote bundle W has reached further to the rear than the Russell plow section 25.

Finally, when the banknote bundle W has reached a position above the intake hole 17H, the controller 4 causes the banknote bundle W to fall from the bundle conveyance path 3Y. At a stage when the banknote bundle W has dropped to slightly below the bundle conveyance path 3Y, the banknote bundle W enters the reject storage box 17 through the intake hole 17H. Inside the reject storage box 17, the banknote bundle W contacts the main guide face 55 in the guide space 52, and drops downward inside the guide space 52 with a lower face of the banknote bundle W sliding against the main guide face 55. Finally, the banknote bundle W reaches and is stored in the second storage space 37.

In this manner, the reject storage box 17 takes in reject banknotes through the passage hole 17U to be stored in the first storage space 36, and takes in a banknote bundle W that a user has forgotten to take (namely a bundle of forgotten banknotes) through the intake hole 17H, such that the banknote bundle W drops down the main guide face 55 inside the guide space 52 to reach the second storage space 37 to be stored.

3. Advantageous Effects, Etc.

Figure 4A:
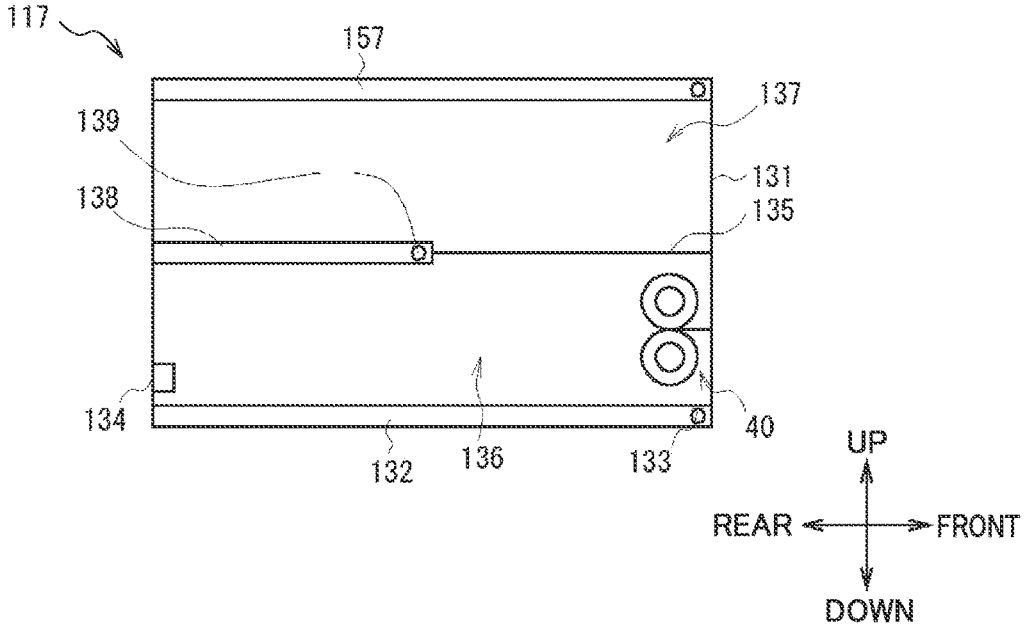
FIG. 4A is a schematic line drawing illustrating configuration of a related reject box.

Explanation now follows regarding a related reject storage box 117, by way of comparison with the reject storage box 17 according to the present exemplary embodiment. As illustrated in FIG. 4A, the related reject storage box 117 is configured around a storage body 131 that has a size corresponding to that of the storage body 31 and the cover body 32 of the present exemplary embodiment when integrated together. The storage body 131 is formed in a hollow rectangular block shape, and is open at an upper face and a lower face.

A thin, plate shaped cover body 132 is provided at the lower face of the storage body 131. The cover body 132 is capable of transitioning to either a closed state or an open state of the lower face of the storage body 131 by pivoting about a pivot shaft 133. A lock 134 maintains the closed state of the cover body 132 when locked, and permits the cover body 132 to pivot when unlocked.

A fixed partitioning plate 135 and a movable partitioning plate 138 are provided substantially at the up-down direction center of the storage body 131 at a front side and a rear side, respectively, to partition a space inside the storage body 131 into top and bottom. Accordingly, the space inside the storage body 131 is split into a first storage space 136 on the lower side, and a second storage space 137 on the upper side. The movable partitioning plate 138 is capable of pivoting about a pivot shaft 139.

Figure 4B:
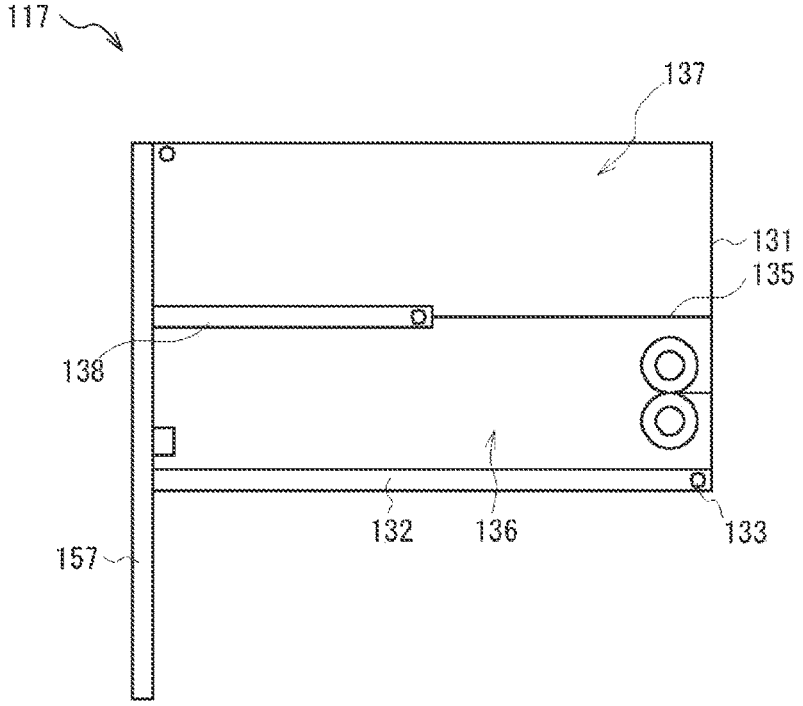
FIG. 4B is a schematic line drawing illustrating configuration of a related reject box.

A shutter 157 is provided at an upper face of the storage body 131. When the shutter 157 is positioned at the upper side of the storage body 131, the upper side of the second storage space 137 is completed closed. As illustrated in FIG. 4B, when the shutter 157 slides toward the rear and rotates by approximately 90° such that a rear end thereof moves downward, the upper side of the second storage space 137 adopts a completely open state.

Note that the related reject storage box 117 is mounted to the storage casing 10 of the storage unit 2 in the closed state of the upper side of the second storage space 137 by the shutter 157 (FIG. 4A), and the upper side of the second storage space 137 adopts the open state (FIG. 4B) when the shutter 157 is pulled out to the rear and rotated in a manual operation by a technician or the like.

In a mounted state of the related reject storage box 117 to the storage casing 10, the first storage space 136 stores reject banknotes conveyed from the switching section 15 (FIG. 1). The second storage space 137 also stores banknote bundles W when a banknote bundle W that a user has forgotten to take from the pay-out port 26 (namely forgotten banknotes) has been conveyed along the bundle conveyance path 3Y and has fallen from the bundle conveyance path 3Y.

The related reject storage box 117 cannot be removed from the storage casing 10 unless the related reject storage box 117 has transitioned from the open state of the upper side of the second storage space 137 (FIG. 4B) to the closed state of the upper side of the second storage space 137 (FIG. 4A) by rotating and moving the shutter 157 toward the front.

When a technician or the like retrieves banknotes stored in the first storage space 136 and the second storage space 137, first, when the related reject storage box 117 is removed from the storage casing 10 in the closed state of the upper side of the second storage space 137 by the shutter 157 (FIG. 4A), the related reject storage box 117 is turned upside down to give a state in which the cover body 132 faces upward.

Figure 5A:
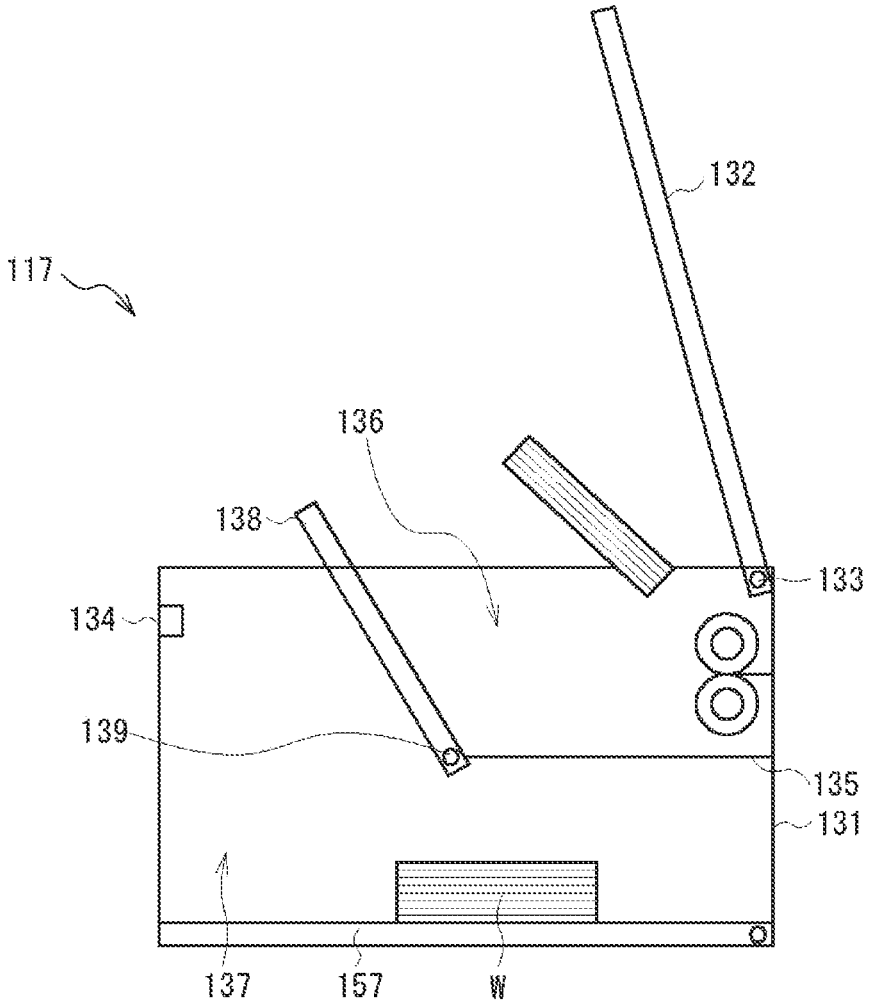
FIG. 5A is a schematic line drawing illustrating configuration of a related reject box.

Then, as illustrated in FIG. 5A, the first storage space 136 of the related reject storage box 117 is opened by rotating the cover body 132 after unlocking the lock 34, thereby allowing the technician or the like to remove the banknotes stored within. The movable partitioning plate 138 is then rotated to partially open the second storage space 137 of the related reject storage box 117, thereby allowing the technician or the like to remove the banknote bundles W inside the second storage space 137.

Figure 5B:
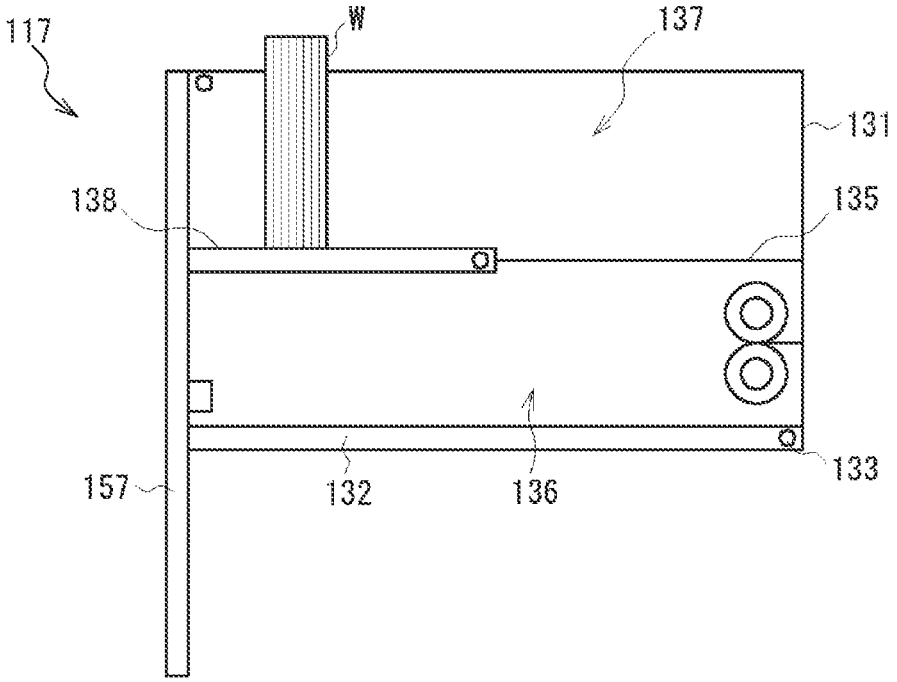
FIG. 5B is a schematic line drawing illustrating configuration of a related reject box.

However, in the related reject storage box 117, in cases in which, for example, the orientation of a banknote bundle W that has fallen from the bundle conveyance path 3Y is lost while falling, sometimes a portion of the banknote bundle W sticks out from the second storage space 137 as illustrated in FIG. 5B. When this occurs, there is a concern of being unable to close the shutter 157, such that the related reject storage box 117 cannot be removed from the storage casing 10. Moreover, sometimes the stacked state of the banknotes collapses when the related reject storage box 117 is turned upside down.

By contrast, in the reject storage box 17 of the present exemplary embodiment, (FIG. 2A, FIG. 2B), the sufficiently thick cover body 32 is provided above the second storage space 37 that stores banknote bundles W that a user has forgotten to take (forgotten banknotes), and the guide space 52 is provided penetrating the cover body 32 in an oblique direction. Accordingly, in the reject storage box 17, when a banknote bundle W falls from the bundle conveyance path 3Y (FIG. 1) above, the lower face of the banknote bundle W contacts the main guide face 55, and the banknote bundle W drops along the main guide face 55, finally reaching the second storage space 37 to be stored.

When this occurs, in the reject storage box 17, after the banknote bundle W falls from the bundle conveyance path 3Y and enters the intake hole 17H, the lower face of the banknote bundle W immediately contacts a portion toward the top of the main guide face 55, and the banknote bundle W travels downward through the guide space 52 with the lower face of the banknote bundle W sliding against the main guide face 55. The reject storage box 17 thereby enables the banknote bundle W dropping through the guide space 52 to be maintained in a substantially uniform orientation, and ultimately enables the banknote bundle W to be stacked neatly inside the second storage space 37.

In the reject storage box 17, the guide spacing D1, this being the spacing between the main guide face 55 and the auxiliary guide face 56 in the guide space 52, is shorter than the length of the banknote short edge. Thereby, even if a leading edge (lower edge) of the banknote bundle W dropping through the guide space 52 is, for example, lifting up from the main guide face 55 and the banknote bundle W is on the verge of losing its orientation, the reject storage box 17 enables any change in orientation to be suppressed to a small amount by causing the banknote bundle W to contact the auxiliary guide face 56, thereby obstructing rotation of the banknote bundle W. This thereby enables the reject storage box 17 to prevent a banknote bundle W from being stored inside the second storage space 37 in a state in which it has undergone a major loss of orientation, as illustrated in FIG. 5B.

In the reject storage box 17, a separation between the upper face of the second storage space 37 and a lower face of the shutter 57, namely the distance between the intake hole 17H and the insertion hole 51, is somewhat extended, and the guide space 52 is formed between the upper face of the second storage space 37 and the lower face of the shutter 57. In other words, in the banknote pay-out device 1, the guide space 52 is formed inside the reject storage box 17, rather than on the storage casing 10 side.

Accordingly, in the reject storage box 17, even if a banknote bundle W that had reached the second storage space 37 were to lose its orientation, and a portion of the banknote bundle W were to project out further toward the upper side than the upper face of the second storage space 37, the likelihood of this projecting portion remaining in the guide space 52 so as to reach as far as the lower face of the shutter 57 is extremely low. This thereby enables avoidance of the issue that can arise in the related reject storage box 117, namely of becoming unable to pull the related reject storage box 117 out of the storage casing 10 due to being unable to close the shutter 57 (FIG. 5B).

Moreover, in the reject storage box 17, the first storage space 36 and the second storage space 37 inside the storage body 31 are disposed side-by-side to the front and rear, and the upper sides thereof are opened or closed by the cover body 32 (FIG. 2A and FIG. 3). The reject storage box 17 thereby enables both reject banknotes inside the first storage space 36 and forgotten banknotes inside the second storage space 37 to be easily removed simply by opening the cover body 32.

Namely, the reject storage box 17 enables removal of the respective banknotes by simple operational procedures, without performing an operation to turn it upside down, or performing an operation to rotate the movable partitioning plate 138 in addition to the cover body 132 that is necessary in the related reject storage box 117 (FIG. 4A, FIG. 4B). The reject storage box 17 moreover enables collapse of the stacked state of stored banknotes to be avoided, since there is no need to turn it upside down.

The anti-sliding grooves 44 are provided inside the first storage space 36 in the reject storage box 17. In the reject storage box 17, when a banknote conveyed from the switching section 15 (namely a reject banknote) is discharged from the discharge section 40 toward the rear, the rear edge of the banknote strikes the front face of the partitioning plate 35. When this occurs, the anti-sliding grooves 44 prevent the rear edge of the banknote from sliding downward along the front face of the partitioning plate 35, thereby enabling the sheet faces of the banknote to be maintained in a substantially horizontal state. The reject storage box 17 thereby enables banknotes to be stacked neatly on top of each other inside the first storage space 36.

The reject storage box 17 is provided with the tongue piece roller 43 that rotates in the arrow R2 direction inside the first storage space 36. The reject storage box 17 is capable of tapping the vicinity of the front edge of a banknote that has been discharged toward the rear from the discharge section 40 such that the rear edge has struck the front face of the partitioning plate 35 downward using the tongue pieces of the tongue piece roller 43. In particular, due to providing the anti-sliding grooves 44, the reject storage box 17 is capable of maintaining banknotes that have struck the front face of the partitioning plate 35 in a substantially horizontal state, and consequently the reject storage box 17 is also capable of reliably positioning and actively tapping down the front edges of the banknotes within a rotation radius of the tongue piece roller 43. This thereby enables the reject storage box 17 to avoid collisions between banknotes already stored inside the first storage space 36 and banknotes subsequently discharged from the discharge section 40, thereby enabling deterioration of the stacked state and damage to banknotes to be forestalled.

According to the above configuration, the reject storage box 17 is provided with the sufficiently thick cover body 32 above the second storage space 37 that stores a banknote bundle W that a user has forgotten to take (forgotten banknotes), and is provided with the guide space 52 penetrating the cover body 32 in an oblique direction. In the reject storage box 17, when a banknote bundle W falls from the bundle conveyance path 3Y (FIG. 1) above into the intake hole 17H, the lower face of the banknote bundle W immediately contacts a portion toward the top of the main guide face 55, and the banknote bundle W travels downward inside the guide space 52 with the lower face of the main guide face 55 sliding against the main guide face 55. The reject storage box 17 thereby enables the banknote bundle W dropping through the guide space 52 to be maintained at a substantially uniform orientation, and ultimately enables the banknote bundle W to be stacked neatly inside the second storage space 37.

4. Other Exemplary Embodiments

Figure 6A:
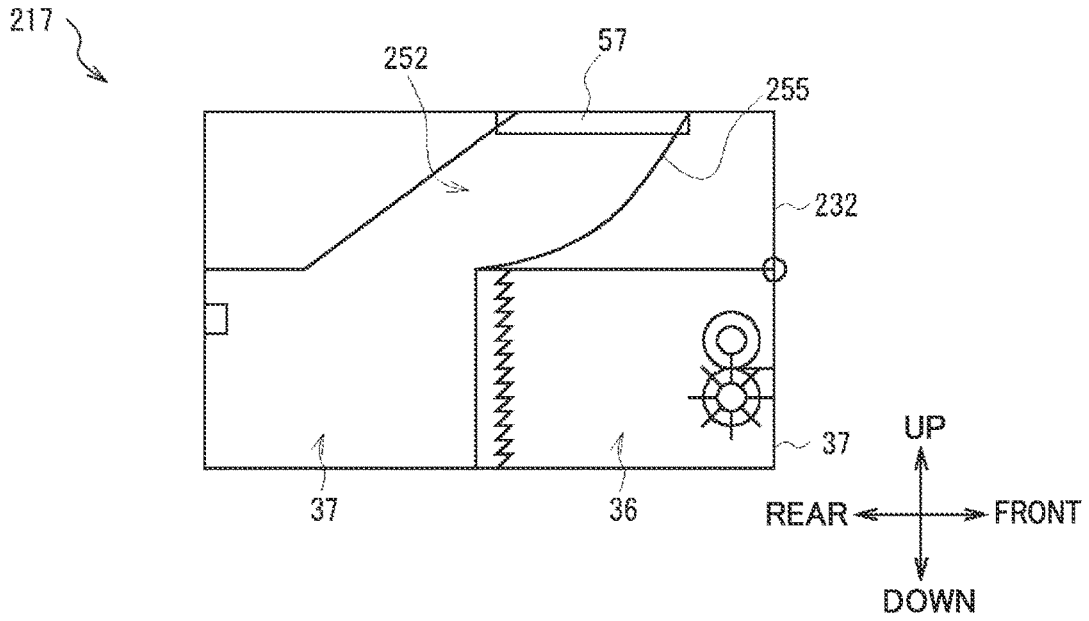
FIG. 6A is a schematic line drawing illustrating configuration of a reject box of another exemplary embodiment.

In the exemplary embodiment described above, explanation has been given regarding a case in which the main guide face 55 (FIG. 2A, FIG. 2B) is formed as a flat face. However, the present invention is not limited thereto, and the main guide face 55 may be formed as a curved face. For example, as in a reject storage box 217 illustrated in FIG. 6A, a main guide face 255 configured by a curved face may be provided at a front side of a guide space 252. In such a configuration, even if a banknote bundle W has fallen from the bundle conveyance path 3Y (FIG. 1) in an orientation with the leading end facing downward, the banknote bundle W slides against the main guide face 255, thereby enabling the banknote bundle W to approach an orientation in which the sheet faces face up and down, namely the orientation when stored in the second storage space 37.

In the exemplary embodiment described above, explanation has been given regarding a case in which the guide spacing D1, this being the spacing between the auxiliary guide face 56 and the main guide face 55, is shorter than the length of a banknote short edge. However, the present invention is not limited thereto, and, for example, the guide spacing D1 may be made longer than the length of the short edge of a banknote in cases in which the angle of inclination of the main guide face 55 with respect to the horizontal direction is comparatively small and there is a low likelihood of a banknote bundle W rotating as it falls inside the guide space 52.

In the exemplary embodiment described above, explanation has been given regarding a case in which the angles of inclination of the auxiliary guide face 56 and the main guide face 55 with respect to the horizontal direction are aligned so as to be equal to each other, and the auxiliary guide face 56 and the main guide face 55 run substantially parallel to each other. However, the present invention is not limited thereto, and, for example, the front-rear direction length of the guide space 52 may be made wider on the lower side than the upper side by configuring the angle of inclination of the auxiliary guide face 56 with respect to the horizontal direction smaller than the angle of inclination the main guide face 55 with respect to the horizontal direction.

In the exemplary embodiment described above, explanation has been given regarding a case in which the both the auxiliary guide face 56 and the main guide face 55 are configured as flat plate faces. However, the present invention is not limited thereto, and, for example, plural plate members with plate faces facing in the left-right direction may be disposed at separations in the left-right direction in the manner of what are known as ribs, with side edges thereof aligned with the position of the front face of the guide space 52, such that the side edges collectively configure the auxiliary guide face 56. In short, the auxiliary guide face 56 may be configured in various shapes as long as a falling banknote bundle W can be kept within the guide space 52. Similar also applies to the main guide face 55, the rear lower side plate 53, and the front lower side plate 54.

Figure 6B:
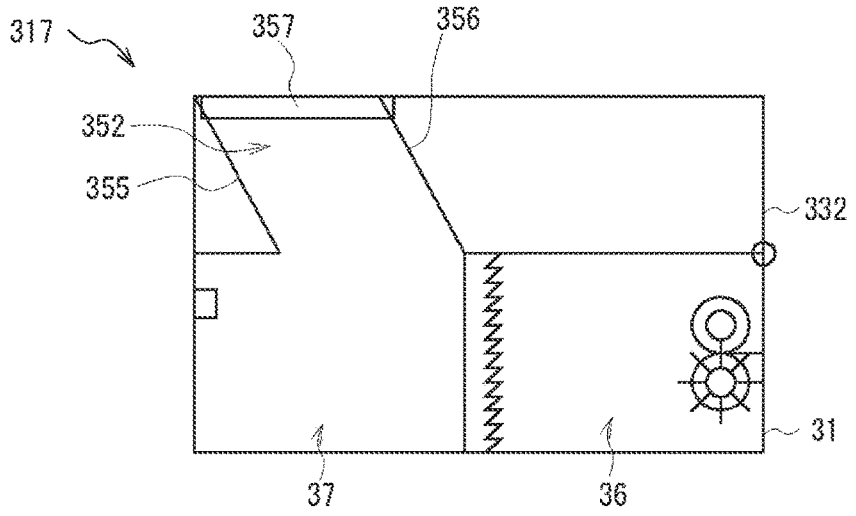
FIG. 6B is a schematic line drawing illustrating configuration of a reject box of another exemplary embodiment.

In the exemplary embodiment described above, explanation has been given regarding a case in which the main guide face 55 is positioned at the front face of the guide space 52, and is disposed almost directly above the first storage space 36. Banknote bundles W fall from above and in front of the second storage space 37 and drop down along the main guide face 55 (FIG. 2A, FIG. 2B). However, the present invention is not limited thereto, and, for example, as in a reject storage box 317 illustrated in FIG. 6B, a main guide face 355 may be positioned at the rear side of a guide space 352, namely almost directly above the second storage space 37, and banknote bundles W may fall from above the rear of the second storage space 37, namely from above on the opposite side to the first storage space 36, and drop down along the main guide face 355.

In the exemplary embodiment described above, explanation has been given regarding a case in which the main guide face 55 is positioned on the front side of the guide space 52 (FIG. 2A, FIG. 2B), similarly to the pay-out port 26. However, the present invention is not limited thereto, and, for example, the main guide face 55 may be on the rear side of the guide space 52, namely the opposite side to the pay-out port 26, in cases in which, for example, the attachment direction of the storage unit 2 to the bundle conveyance unit 3 is inverted from front to rear, and the banknote storage boxes 11 and the reject storage box 17 are pulled out toward the rear with respect to the storage casing 10.

In the exemplary embodiment described above, explanation has been given regarding a case in which the pivot portion 33 is disposed at the front upper end of the storage body 31, and the upper faces of the first storage space 36 and the second storage space 37 are opened or closed by turning the cover body 32 about the pivot portion 33 (FIG. 2A and FIG. 3). However, the present invention is not limited thereto, and, for example, the pivot portion 33 may be provided at a rear upper end or at left and right upper ends of the storage body 31. Moreover, instead of the pivot portion 33, a known slide mechanism or link mechanism may be provided, or the cover body 32 may be configured so as to be detachable with respect to the storage body 31. Namely, it is sufficient that the upper faces of the first storage space 36 and the second storage space 37 can transition easily between a closed state in which the cover body 32 is positioned at a position superimposed directly above the storage body 31, and an open state in which the upper faces of the first storage space 36 and the second storage space 37 are open.

Figure 7A:
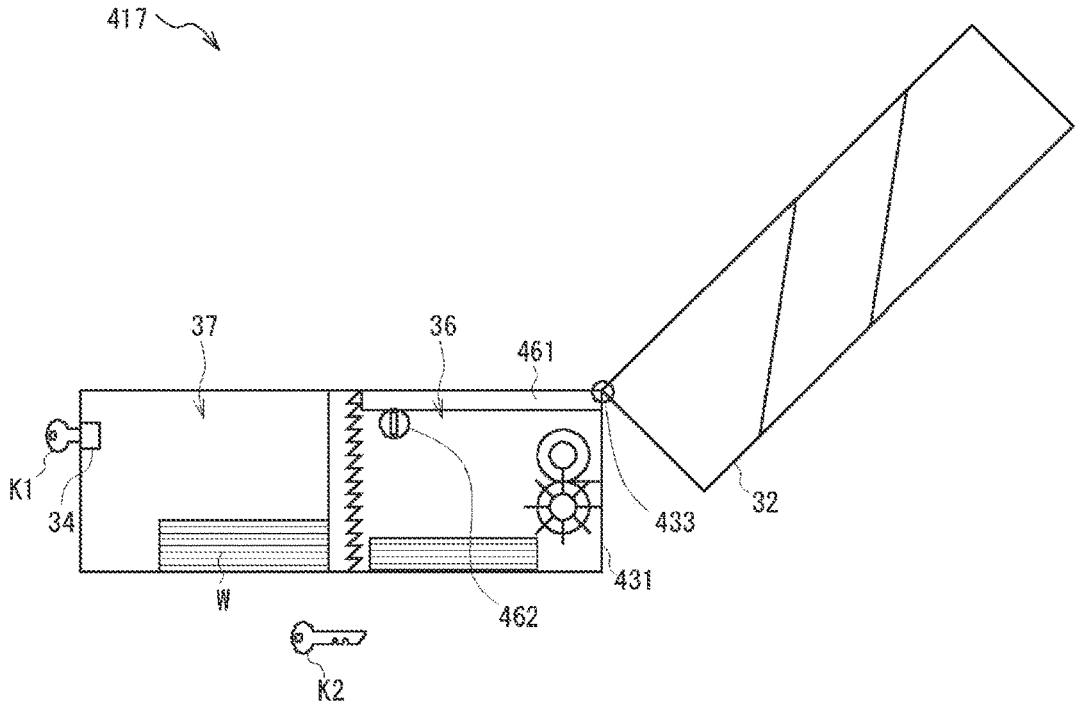
FIG. 7A is a schematic line drawing illustrating configuration of a reject box of another exemplary embodiment.

In the exemplary embodiment described above, explanation has been given regarding a case in which the upper faces of both the first storage space 36 and the second storage space 37 are opened by turning the cover body 32 in the arrow R1 direction with respect to the storage body 31 so as to achieve the open state (FIG. 3). However, the present invention is not limited thereto, and, for example, as in a reject storage box 417 illustrated in FIG. 7A, an inner cover 461, serving as a separate cover body, may be provided at the upper face of the first storage space 36 of a storage body 431. The inner cover 461 may be configured so as to be capable of turning about a pivot portion 433 similarly to the cover body 32, and the inner cover 461 may be configured so as to be lockable by a second lock 462.

Figure 7B:
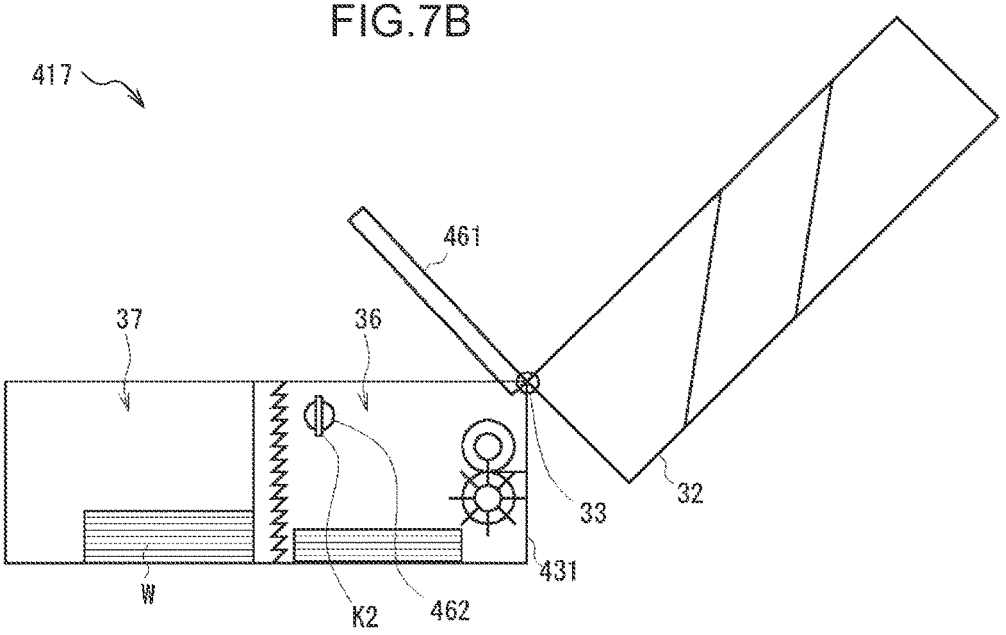
FIG. 7B is a schematic line drawing illustrating configuration of a reject box of another exemplary embodiment.

In the reject storage box 417, when the lock 34 has been unlocked with the key K1, the cover body 32 is turned to open the second storage space 37. However, the first storage space 36 remains closed by the inner cover 461. In the reject storage box 417, as illustrated in FIG. 7B, when the second lock 462 has been unlocked with a key K2, the inner cover 461 can be turned to open the first storage space 36. Accordingly, in the reject storage box 417, for example, a technician with low-level security clearance may be entrusted with only the key K1, and a technician with high-level security clearance may be entrusted with both the key K1 and the key K2, thereby enabling the only the technician with high-level security clearance to remove banknotes (reject banknotes) from inside the first storage space 36.

Figure 8A:
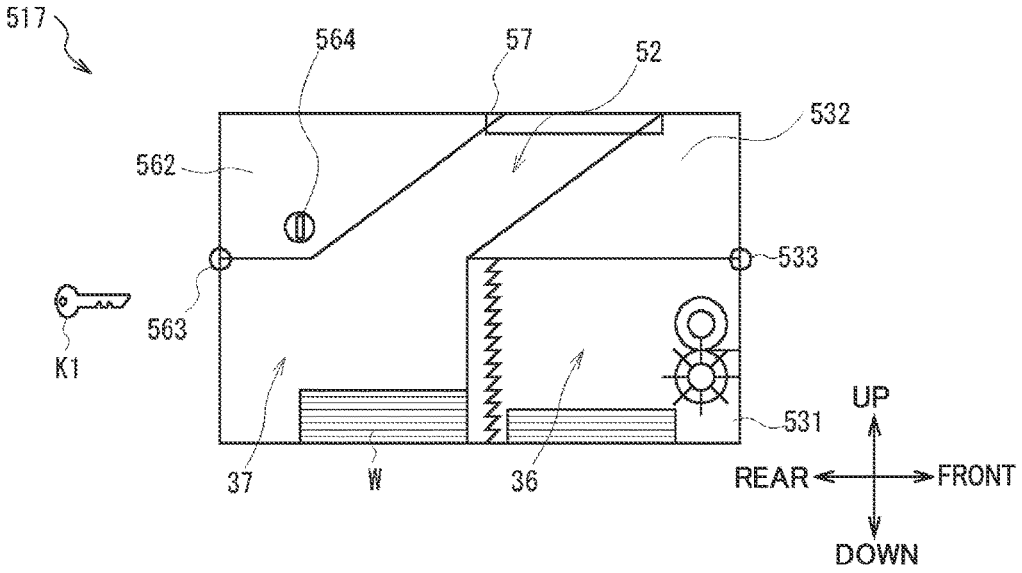
FIG. 8A is a schematic line drawing illustrating configuration of a reject box of another exemplary embodiment.
Figure 8B:
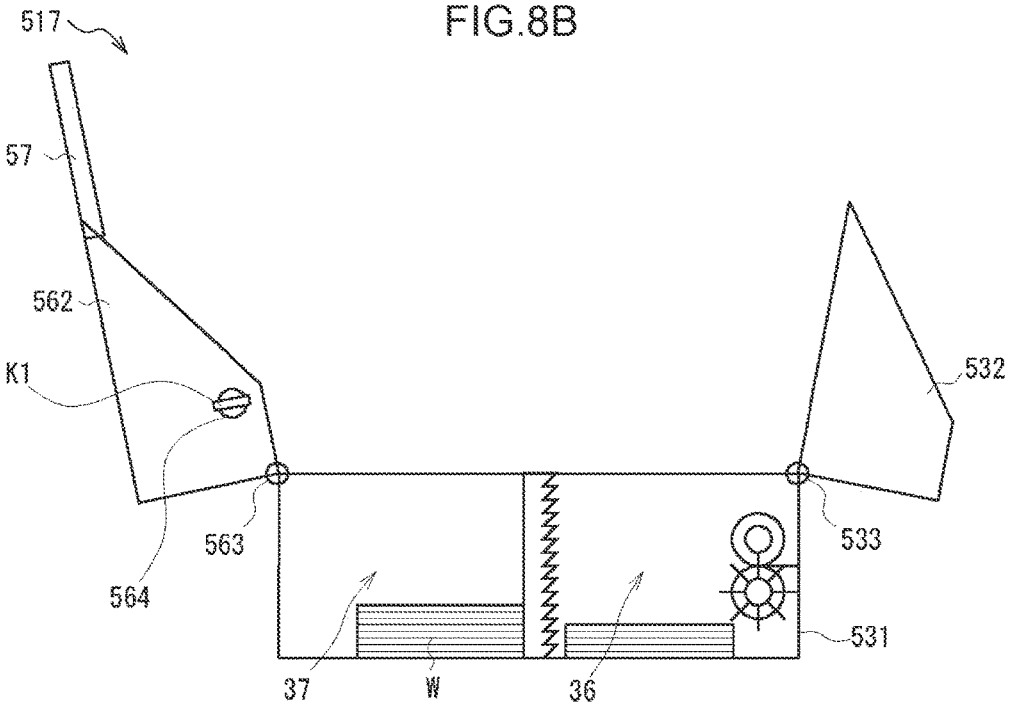
FIG. 8B is a schematic line drawing illustrating configuration of a reject box of another exemplary embodiment.

In the exemplary embodiment described above, explanation has been given regarding a single cover body 32 provided at the upper side of the storage body 31. However, the present invention is not limited thereto, and, for example, a cover body divided into plural parts may be provided at the upper side of the storage body 31. For example, a reject storage box 517 illustrated in FIG. 8A is provided with a front cover body 532 on the front side, and a rear cover body 562 on the rear side, so as to surround the guide space 52 from the front and rear at the upper side of a storage body 531. As illustrated in FIG. 8B, the front cover body 532 serving as a separate cover body turns about a pivot portion 533 provided at a front upper end of the storage body 531. The rear cover body 562 turns together with the shutter 57 about a pivot portion 563 provided at a rear upper end of the storage body 531. The rear cover body 562 is provided with a lock 564, and the upper side of the storage body 531 is maintained in a closed state when locked using the key K1. Moreover, in the reject storage box 517, a second lock may be provided to the front cover body 532 similarly to in the reject storage box 417 described above (FIG. 7A, FIG. 7B), and the front cover body 532 may be capable of turning only when the second lock has been unlocked with a second key.

In the exemplary embodiment described above, explanation has been given regarding a case in which the intake hole 17H is opened or closed by sliding the shutter 57 with respect to the cover body 32. However, the present invention is not limited thereto, and, for example, the intake hole 17H may be opened or closed by various methods, such as by turning the shutter 57 with respect to the cover body 32. There is no limitation to configuring the shutter 57 from a single plate shaped member, and, for example, the shutter 57 may be configured from two or more plate shaped members. Alternatively, for example, the shutter 57 may be omitted in cases in which the intake hole 17H is sufficiently narrow, and long enough in the up-down direction, that security can be assured.

In the exemplary embodiment described above, explanation has been given regarding a case in which the first storage space 36 is provided with the tongue piece roller 43 and the anti-sliding grooves 44. However, the present invention is not limited thereto, and, for example, at least one of the tongue piece roller 43 or the anti-sliding grooves 44 may be omitted.

In the exemplary embodiment described above, explanation has been given regarding a case in which both forgotten banknotes and reject banknotes are stored inside the reject storage box 17, due to providing the first storage space 36 and the second storage space 37. However, the present invention is not limited thereto, and, for example, configuration may be made in which only forgotten banknotes are stored inside the reject storage box 17, by omitting the first storage space 36.

In the exemplary embodiment described above, explanation has been given regarding a case in which the lock 34 is provided, and the cover body 32 can only be turned when the lock 34 has been unlocked with the key K1. However, the present invention is not limited thereto, and, for example, the lock 34 may be omitted, and the cover body 32 may be configured capable of turning as long as the reject storage box 17 is in a state removed from the storage casing 10 of the storage unit 2 (FIG. 1).

In the exemplary embodiment described above, explanation has been given regarding a case in which the banknote bundle W is caused to fall into the intake hole 17H of the reject storage box 17 from the bundle conveyance unit 3, in which the banknote bundle W is pushed along the upper face of the gripping conveyance guide 22 and the like by the Russell plow section 25. However, the present invention is not limited thereto, and, for example, the banknote bundle W may be caused to fall into the intake hole 17H from a bundle conveyance section that conveys the banknote bundle W by various methods, such as by conveying the banknote bundle W gripped from above and below, and that releases this gripping to cause the banknote bundle W to fall into the intake hole 17H.

In the exemplary embodiment described above, explanation has been given regarding a case in which the present invention is applied to the reject storage box 17 that takes in banknote bundles W of stacked banknotes, serving as a paper sheet shaped medium, through the intake hole 17H provided at an upper face to be stored inside the second storage space 37 in the banknote pay-out device 1 that pays out banknotes stacked in a bundle. However, the present invention is not limited thereto, and, for example, the present invention may be applied to storage boxes that take in bundles of a medium through an intake hole provided at an upper face to be stored internally in various devices that handle medium bundles configured by stacking various paper sheet shaped media such as securities or cash vouchers, or shopping vouchers or entrance tickets.

The present invention is not limited to the respective exemplary embodiments described above and the other exemplary embodiments described above. Namely, the present invention encompasses application to exemplary embodiments combining some or all elements of the respective exemplary embodiments described above and the other exemplary embodiments described above, and exemplary embodiments deriving from elements thereof.

In the exemplary embodiment described above, explanation has been given regarding a case in which the reject storage box 17, serving as a medium bundle storage device, is configured by the intake hole 17H serving as an intake hole, the second storage space 37 serving as a medium bundle storage space, the main guide face 55 serving as a main guide face, the auxiliary guide face 56 serving as an auxiliary guide face, and the guide space 52 serving as a guide space. However, the present invention is not limited thereto, and a medium storage device may be configured by intake holes, medium bundle storage spaces, main guide faces, auxiliary guide faces, and guide spaces of various other configurations.

In the exemplary embodiment described above, explanation has been given regarding a case in which the banknote pay-out device 1, serving as a medium processing device, is configured by the bundle conveyance unit 3 serving as a bundle conveyance section, and the reject storage box 17 serving as a medium bundle storage box, with the medium bundle storage box being configured by the intake hole 17H serving as an intake hole, the second storage space 37 serving as a medium bundle storage space, the main guide face 55 serving as a main guide face, the auxiliary guide face 56 serving as an auxiliary guide face, and the guide space 52 serving as a guide space. However, the present invention is not limited thereto, and a medium processing device may be configured by bundle conveyance sections and medium bundle storage boxes of various other configurations, and the medium bundle storage box may be configured by intake holes, medium bundle storage spaces, main guide faces, auxiliary guide faces, and guide spaces of various other configurations.

INDUSTRIAL APPLICABILITY

The present invention may be employed in banknote pay-out devices that, for example, pay out banknotes stacked in a bundle according to operation by a user.

The invention claimed is:

1. A medium bundle storage device comprising:

an intake hole that takes in a medium bundle of a stacked paper sheet shaped medium;

a medium bundle storage space that is disposed further toward a lower side than the intake hole, and that stores the medium bundle;

a main guide face that connects the intake hole and the medium bundle storage space together, and that is inclined with respect to a horizontal direction;

an auxiliary guide face that faces the main guide face across a separation of at least a specific guide spacing; and a guide space that is formed between the main guide face and the auxiliary guide face, and that guides the medium bundle toward the medium bundle storage space.

2. The medium bundle storage device of claim 1, wherein the guide spacing is shorter than the length of the medium along a direction of travel of the medium bundle.

3. The medium bundle storage device of claim 1, further comprising:

a storage body that is internally formed with the medium bundle storage space; and a cover body that is provided with the intake hole, the main guide face, the auxiliary guide face, and the guide space, and that opens or closes the medium bundle storage space by undergoing positional displacement with respect to the storage body.

4. The medium bundle storage device of claim 3, further comprising a separate storage space that is internally formed in the storage body separately from the medium bundle storage space, and that stores the medium, wherein the cover body opens or closes the medium bundle storage space and the separate storage space by undergoing positional displacement with respect to the storage body.

5. The medium bundle storage device of claim 4, further comprising:

a discharge section that discharges the medium into the separate storage space in an orientation in which sheet faces of the medium face up and down; and a tongue piece that taps the medium discharged into the separate storage space in a direction away from the discharge section.

6. The medium bundle storage device of claim 4, further comprising:

a discharge section that discharges the medium into the separate storage space in an orientation in which sheet faces of the medium face up and down; and an anti-sliding section that is provided inside the separate storage space at a location facing the discharge section, and that prevents sliding of a leading end of the medium in a direction away from the discharge section.

7. The medium bundle storage device of claim 3, further comprising:

a separate storage space that is internally formed in the storage body separately from the medium bundle storage space, and that stores the medium; and a separate cover body that opens or closes the separate storage space by undergoing positional displacement with respect to the storage body.

8. The medium bundle storage device of claim 1, further comprising:

a storage body that is internally formed with a separate storage space that stores the medium, and with the medium bundle storage space;

a cover body that opens or closes the medium bundle storage space by undergoing positional displacement with respect to the storage body, and that is provided to one out of the main guide face or the auxiliary guide face; and a separate cover body that opens or closes the separate storage space by undergoing positional displacement with respect to the storage body, and that is provided to the other out of the main guide face or the auxiliary guide face, wherein the guide space is formed between the main guide face and the auxiliary guide face when the cover body and the separate cover body are closed.

9. A medium processing device comprising:

a bundle conveyance section that conveys a medium bundle of a stacked paper sheet shaped medium; and a medium bundle storage box that takes in and stores the medium bundle conveyed by the bundle conveyance section, wherein the medium bundle storage box includes an intake hole that takes in the medium bundle from the bundle conveyance section, a medium bundle storage space that is disposed further toward a lower side than the intake hole, and that stores the medium bundle, a main guide face that connects the intake hole and the medium bundle storage space together, and that is inclined with respect to a horizontal direction, an auxiliary guide face that faces the main guide face across a separation of at least a specific guide spacing, and a guide space that is formed between the main guide face and the auxiliary guide face, and that guides the medium bundle toward the medium bundle storage space.

* * * * *